US008531385B2

(12) United States Patent
Kim et al.

(10) Patent No.: US 8,531,385 B2
(45) Date of Patent: Sep. 10, 2013

(54) DRIVING METHOD FOR LOCAL DIMMING OF LIQUID CRYSTAL DISPLAY DEVICE AND APPARATUS USING THE SAME

(75) Inventors: Dong-Woo Kim, Seoul (KR); Si-Hoon Lee, Incheon (KR); Kyo-Hyuck Choo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 436 days.

(21) Appl. No.: 12/869,520

(22) Filed: Aug. 26, 2010

(65) Prior Publication Data

US 2011/0148941 A1 Jun. 23, 2011

(30) Foreign Application Priority Data

Dec. 18, 2009 (KR) ..... 10-2009-0126974

(51) Int. Cl.
*G09G 3/36* (2006.01)
*G09G 5/10* (2006.01)

(52) U.S. Cl.
USPC ..... 345/102; 345/690

(58) Field of Classification Search
USPC ..... 345/87–102, 690
See application file for complete search history.

(56) References Cited

U.S. PATENT DOCUMENTS

| | | | | |
|---|---|---|---|---|
| 2005/0007389 | A1 | 1/2005 | Kumamoto et al. | |
| 2009/0109165 | A1* | 4/2009 | Park et al. | 345/102 |
| 2010/0053222 | A1* | 3/2010 | Kerofsky | 345/690 |

FOREIGN PATENT DOCUMENTS

| | | | |
|---|---|---|---|
| CN | 101345036 | A | 1/2009 |
| CN | 101425275 | A | 5/2009 |
| CN | 101453813 | A | 6/2009 |
| CN | 101494031 | A | 7/2009 |
| CN | 101494033 | A | 7/2009 |

OTHER PUBLICATIONS

Office Action issued in corresponding Chinese Patent Application No. 201010290486.9, mailed Jul. 16, 2012.

* cited by examiner

*Primary Examiner* — Kent Chang
*Assistant Examiner* — Scott Au
(74) *Attorney, Agent, or Firm* — Brinks Hofer Gilson & Lione

(57) ABSTRACT

A driving method for local dimming of a Liquid Crystal Display (LCD) device and an apparatus using the same are disclosed. The driving method includes determining a dimming value of each of a plurality of local dimming blocks into which a backlight unit is divided to be driven on a block basis by analyzing input image data on a block basis, detecting a high gray area concentrated with high gray levels from each local dimming block based on the analysis of the input image data, and generating position information about the high gray area according to a distance between the high gray area in the block and an adjacent block, and compensating the dimming value of each of the plurality of local dimming blocks by spatial filtering using a spatial filter having a different filter size or different filter coefficients for local dimming blocks according to the position information about the high gray area in the local dimming block.

10 Claims, 3 Drawing Sheets

DRIVING METHOD FOR LOCAL DIMMING OF LIQUID CRYSTAL DISPLAY DEVICE AND APPARATUS USING THE SAME

This application claims the priority and the benefit under 35 U.S.C. §119(a) on Patent Application No 10-2009-0126974 filed in Republic of Korea on Dec. 18, 2009 the entire contents of which is hereby incorporated by reference.

BACKGROUND

1. Field of the Invention

The present disclosure relates to a Liquid Crystal Display (LCD) device, and more particularly, to a driving method for local dimming of an LCD device to minimize luminance non-uniformity among local dimming blocks, and an apparatus using the same.

2. Discussion of the Related Art

Recently, flat panel displays have been popular as video displays, such as LCDs, Plasma Display Panels (PDPs), Organic Light Emitting Diodes (OLEDs), etc.

An LCD device includes a liquid crystal panel for displaying an image on a pixel matrix relying on the electrical and optical characteristics of liquid crystals that exhibit anisotropy in dielectric constant and refractive index, a driving circuit for driving the liquid crystal panel, and a backlight unit for irradiating light onto the liquid crystal panel. The gray scale of each pixel is adjusted by controlling the transmittance of light that passes from the backlight unit through the liquid crystal panel and polarizers through changing the orientation of liquid crystals according to a data signal.

In the LCD device, the luminance of each pixel is determined by the product between the luminance of the backlight unit and the light transmittance of liquid crystals that depends on data. The LCD device employs backlight dimming method for the purposes of increasing a contrast ratio and reducing power consumption. Backlight dimming is a technique that controls backlight luminance and compensates data by analyzing an input image and adjusting a dimming value based on the analysis. For example, a backlight dimming method intended for reducing power consumption reduces the backlight luminance by decreasing the dimming value and increases the luminance through data compensation. Thus the power consumption of the backlight unit is reduced.

Light Emitting Diode (LED) backlight unit using LEDs as a light source have recently been used for a backlight unit. The LEDs boast of high luminance and low power consumption, compared to conventional lamps. Because the LED backlight unit allows for location-based control, they may be driven by local dimming. According to the local dimming technology, the LED backlight unit is divided into a plurality of light emitting blocks and luminance is controlled on a bock-by-block basis. Local dimming may further increase the contrast ratio and decrease the power consumption since the backlight unit and the liquid crystal panel are divided into a plurality of blocks, local dimming values are decided by analyzing data on a block basis, and data is compensated based on the local dimming values.

In spite of luminance control on a block basis according to an input image, the driving method of the related art for local dimming suffers from halo effects due to luminance non-uniformity caused by light leakage from adjacent blocks. For example, if an image with a bright (high-level) gray pattern over a very dark (low-level) gray pattern is displayed by local dimming, a halo phenomenon occurs, in which a bright block is visible in a dark block due to light leakage, thus degrading image quality. In case of an edge-type backlight unit having LED arrays arranged on at least two edges, as a bright gray pattern is nearer to an adjacent block, luminance non-uniformity among blocks is more perceptible.

BRIEF SUMMARY

A driving method for local dimming of an LCD device includes determining a dimming value of each of a plurality of local dimming blocks into which a backlight unit is divided to be driven on a block basis by analyzing input image data on a block basis, detecting a high gray area concentrated with high gray levels from each local dimming block based on the analysis of the input image data, and generating position information about the high gray area according to a distance between the high gray area in the block and an adjacent block, and compensating the dimming value of each of the plurality of local dimming blocks by spatial filtering using a spatial filter having a different filter size or different filter coefficients for local dimming blocks according to the position information about the high gray area in the local dimming block.

In another aspect, a driving apparatus for local dimming of an LCD device includes an image analyzer for detecting a maximum value for each pixel by analyzing input image data over each of a plurality of local dimming blocks into which a backlight unit is divided to be driven on a block basis, and detecting a representative gray level for each block using the maximum values of pixels in the block, a dimming value decider for determining a dimming value on a block basis according to the representative gray level of each block, a high gray area detector for detecting a high gray area concentrated with high gray levels from each block based on the maximum value of each pixel received from the image analyzer, and generating position information about the high gray area according to a distance between the high gray area in the block and an adjacent block, and a dimming value compensator for compensating the dimming value of each of the plurality of local dimming blocks by spatial filtering using a spatial filter having a different filter size or different filter coefficients for blocks according to the position information about the high gray area in the block.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE DRAWINGS AND THE PRESENTLY PREFERRED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
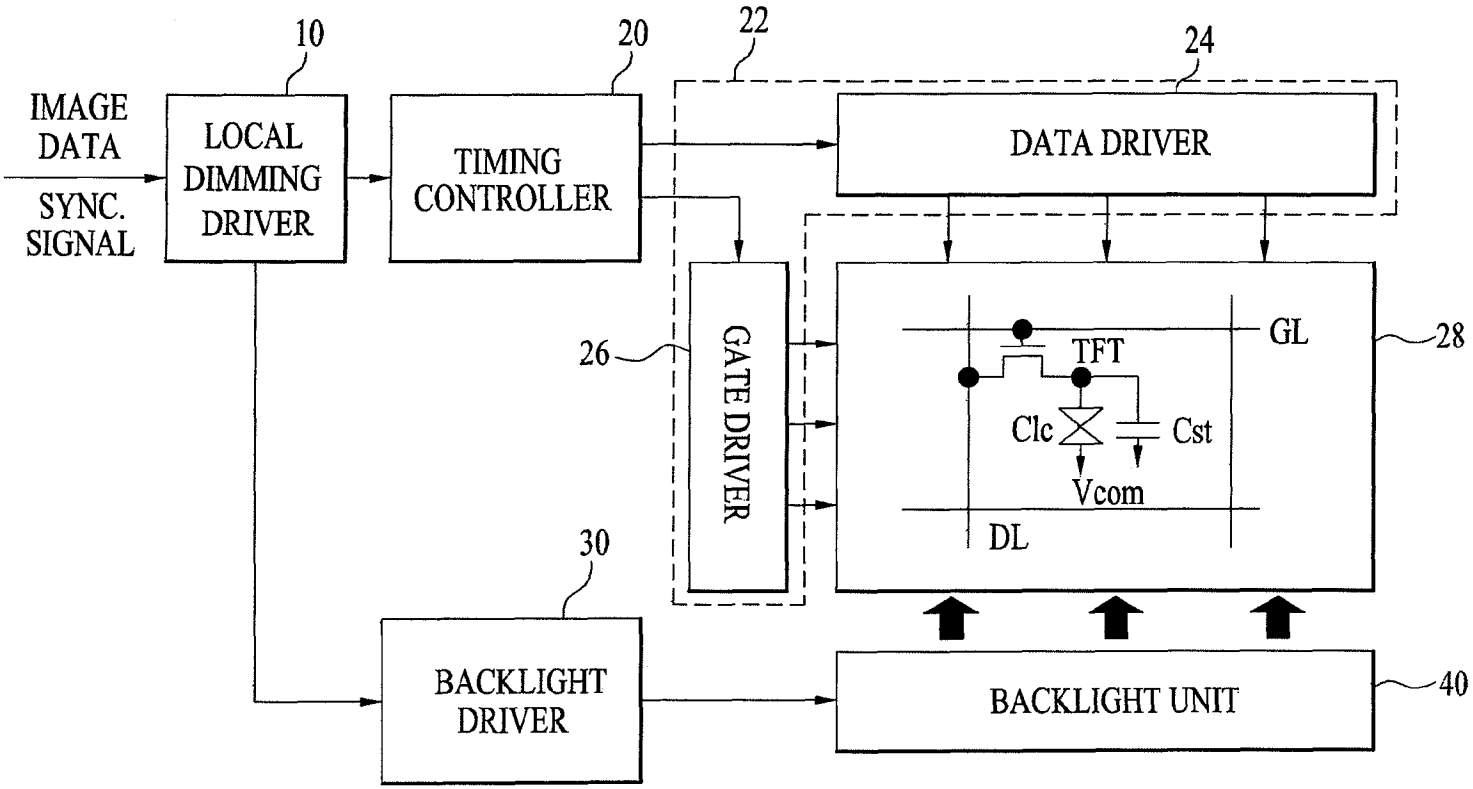
FIG. 1 is a schematic block diagram of a Liquid Crystal Display (LCD) device according to an exemplary embodiment of the present invention.

FIG. 1 is a schematic block diagram of a Liquid Crystal Display (LCD) device according to an exemplary embodiment of the present invention.

Referring to FIG. 1, the LCD device includes a local dimming driver 10 for determining local dimming values by analyzing input image data on a block basis and compensating data according to the local dimming values, a timing controller 20 for providing the data received from the local dimming driver 12 to a panel driver 22 and controlling a driving timing of the panel driver 22, a backlight driver 30 for driving an Light Emitting Diode (LED) backlight unit 40 on a block basis based on the local dimming values received from the local dimming driver 10, and a liquid crystal panel 28 driven by a data driver 24 and a gate driver 26 of the panel driver 22. The local dimming driver 10 may be provided inside the timing controller 20.

In operation, the local dimming driver 10 analyzes input image data on a block basis using synchronization signals and determines dimming values for respective blocks according to the result of the analysis. The local dimming driver 10 primarily compensates the dimming value of each block so as to reduce dimming deviations (i.e. luminance deviations) between the block and its adjacent blocks. The primary compensation is carried out by subjecting the dimming values of the block and its adjacent blocks to spatial filtering using a spatial filter with a filter size corresponding to the block and its adjacent blocks and filter coefficients set respectively for the blocks. As the dimming value of the block is compensated through filtering using a spatial filter with specific weighting values, that is, specific filter coefficients for the block and its adjacent blocks over, under, on the left of, and on the right of the block, the spatial filtering may narrow the differences in dimming value (i.e. luminance) among the blocks.

More specifically, the local dimming driver 10 locates a high gray area concentrated with high gray levels in each block and applies a different filter size or different spatial filter coefficients according to the position of the high gray area, that is, according to the distance between the high gray area of the block and an adjacent block, thereby primarily compensating the dimming value of the block. If the high gray area of the block is farther from an adjacent block, which means that the high gray area less affects the luminance of the adjacent block, the local dimming driver 10 sets a smaller spatial filter size. On the contrary, if the high gray area of the block is nearer to the adjacent block, which means that the high gray area more affects the luminance of the adjacent block, the local dimming driver 10 increases the spatial filter size and the filter coefficient of the adjacent block, thereby further decreasing luminance non-uniformity between the blocks.

In addition, the local dimming driver 10 calculates a first gain value for each pixel in each block based on the dimming value of the block and compensates the input image data by multiplying the first gain values by the input image data.

The local dimming driver 10 also calculates a second gain value for each frame with which to convert a maximum value of the frame to a maximum gray level (e.g. 255), secondarily compensates the input image data by applying the second gain values to the primarily compensated data, and outputs the secondarily compensated data to the timing controller 20. At the same time, the local dimming driver 10 secondarily compensates the primarily compensated dimming values of the respective blocks by applying the second gain values to the primarily compensated dimming values, and outputs the secondarily compensated dimming values to the backlight driver 30. With the second gain values, the values of the primarily compensated data are increased and the primarily compensated dimming values of the blocks are decreased. Therefore, power consumption may be further reduced.

The timing controller 20 orders the data received from the local dimming driver 10 and outputs the ordered data to the data driver 24 of the panel driver 22. The timing controller 20 generates data control signals for controlling driving timings of the data driver 24 and gate control signals for controlling driving timings of the gate driver 26, using a plurality of synchronization signals received from the local dimming driver 10, specifically a vertical synchronization signal, a horizontal synchronization signal, a data enable signal, and a dot clock signal, and outputs the data control signals and the gate control signals respectively to the data driver 24 and the gate driver 26. Meanwhile, the timing controller 20 may further include an overdriving circuit (not shown) for modulating data by applying an overshoot value or an undershoot value to the data according to a data difference between successive frames in order to increase the response speed of liquid crystals.

The panel driver 22 includes the data driver 24 for driving data lines DL of the liquid crystal panel 28 and gate lines GL of the liquid crystal panel 28.

The data driver 24 converts digital video data received from the timing controller 24 to analog data signals (pixel voltage signals) using gamma voltages in response to the data control signals received from the timing controller 20 and provides the analog data signals to the data lines DL of the liquid crystal panel 28.

The gate driver 26 sequentially drives the gate lines GL of the liquid crystal panel 28 in response to the gate control signals received from the timing controller 20.

The liquid crystal panel 28 displays an image through a pixel matrix having a plurality of pixels arranged. Each pixel represents a desired color by combining red, green and blue sub-pixels that control light transmittance through changing the orientation of the liquid crystals according to a luminance-compensated data signal. Each of the sub-pixels includes a Thin Film Transistor (TFT) connected to a gate line GL and a data line DL, and a liquid crystal capacitor Clc and a storage capacitor Cst that are connected to the TFT in parallel. The liquid crystal capacitor Clc is charged with a different voltage between a data signal supplied to a pixel electrode through the TFT and a common voltage Vcom supplied to a common electrode and drives a liquid crystal according to the charged voltage, to thereby control light transmittance. The storage capacitor Cst maintains the voltage charged at the liquid crystal capacitor Clc to be stable.

The backlight unit 40, which uses direct-type LED backlight unit or edge-type LED backlight unit, is divided into a plurality of blocks by the backlight driver 30, and projects light onto the liquid crystal panel 28 as it is driven on a block basis. An LED array of the direct-type LED backlight unit is arranged in an entire display area, facing the liquid crystal panel 28, whereas LED arrays of the edge-type LED backlight unit are arranged to face at least two edges of a light guide plate that faces the liquid crystal panel 28 and linear light sources from the LED arrays are converted to flat light sources and irradiated onto the liquid crystal panel 28.

The backlight driver 30 drives the backlight unit 40 on a block basis according to the local dimming value of each block received from the local dimming driver 10, thus controlling the luminance of the backlight unit 40 on a block basis. If the backlight unit 40 is divided into a plurality of ports and driven on a port basis, a plurality of backlight drivers 30 may be used to drive the plurality of ports independently. For each block, the backlight driver 30 generates a Pulse Width Modulation (PWM) signal having a duty ratio corresponding to the local dimming value of the block and provides an LED driving signal corresponding to the PWM signal to the block. Thus, the backlight unit 40 is driven on a block basis. The backlight driver 30 controls the luminance of the backlight unit 40 on a block basis by sequentially driving light emitting blocks based on the local dimming values received from the local dimming driver 10 in a block connection order.

Accordingly, the LCD device according to the present invention displays the input image data at a final luminance obtained by multiplying the luminance of the backlight unit 40 controlled on a block basis by a light transmittance controlled with the compensated data in the liquid crystal panel 28.

Figure 2:
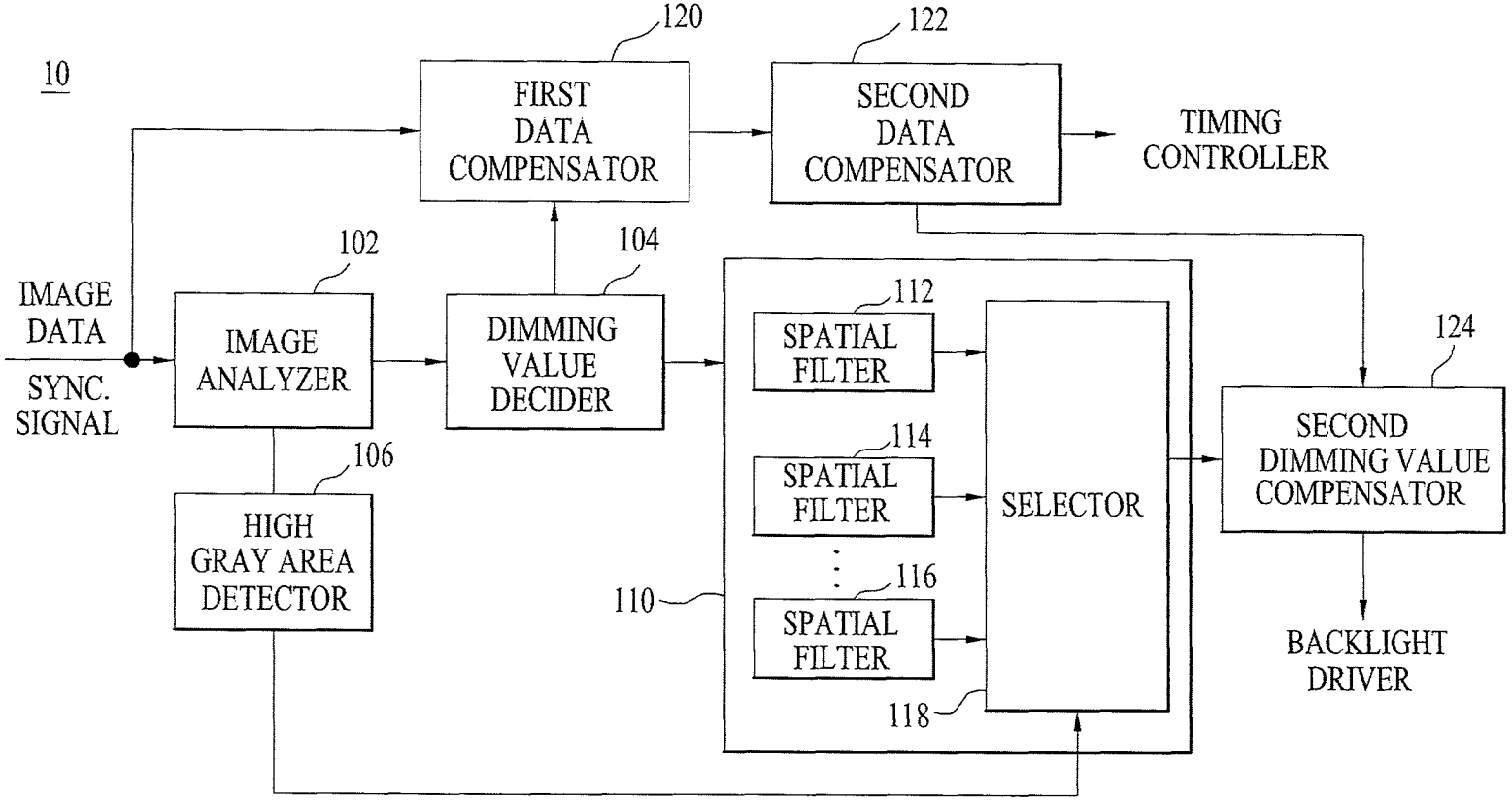
FIG. 2 is a detailed block diagram of a local dimming driver illustrated in FIG. 1.

FIG. 2 is a detailed block diagram of the local dimming driver 10 illustrated in FIG. 1.

Referring to FIG. 2, the local dimming driver 10 includes an image analyzer 102, a dimming value decider 104, a high gray area detector 106, a first dimming value compensator 110, a second dimming value compensator 124, a first data compensator 120, and a second data compensator 122. The first dimming value compensator 110 includes a plurality of spatial filters 112, 114 and 116 and a selector 118.

The image analyzer 102 analyzes input image data over each of a plurality of blocks into which the backlight unit 40 is divided and outputs the analysis results to the dimming value decider 104. Specifically, the image analyzer 102 detects the maximum value of each pixel in the input image data, groups the maximum values of the pixels of the input image data on a block basis, and sums and averages the maximum values of pixels in each block, thereby producing an average value for each block, that is, a representative gray level for each block.

The dimming value decider 104 determines a local dimming value for each block according to the representative gray level of the block and outputs the local dimming values of the blocks to the first dimming value compensator 110 and the first data compensator 120. Specifically, the dimming value decider 104 selects a local dimming value corresponding to a representative gray level from a preset look-up table, for each block.

The high gray area detector 106 detects a high gray area concentrated with high gray levels exceeding a threshold in each block by comparing the maximum value of each pixel of the block with the threshold, detects position information about the high gray area, and outputs a detection signal indicating the detection of the high gray area and the position information about the high gray area to the first dimming value compensator 110. For example, as illustrated in FIGS. 3(A), 3(B) and 3(C), first, second and third positions are defined for a high gray area (white area) according to the distances between the high gray area and an upper adjacent block and position information about the high gray area is set to indicate one of the first, second and third positions. The position information is transmitted together with the detection signal to the first dimming value compensator 110. Meanwhile, if a high gray area is not detected from a block, the high gray area detector 106 outputs a non-detection signal to the first dimming value compensator 110.

The first dimming value compensator 110 primarily compensates the local dimming values on a block basis by processing the local dimming values received from the dimming value decider 104 by spatial filtering using the plurality of spatial filters 112, 114 and 116 having different filter coefficients. The first dimming value compensator 110 selects one of the outputs of the spatial filters 112, 114 and 116 in response to the detection signal and the position information about the high gray area received from the high gray area detector 106 and outputs the selected output to the second dimming value compensator 124. The first dimming value compensator 110 applies a different filter size and different filter coefficients according to the distance between the high gray area of the block and an adjacent block. Therefore, if the distance between the high gray area in the block and an LED array is changed, the first dimming value compensator 110 may mitigate luminance non-uniformity between blocks adaptively.

As illustrated in FIGS. 3(A), 3(B) and 3(C), for example, in the case where first, second and third positions are defined for a high gray area in a block according to distances between the high gray area of the block and an upper block neighboring to the block, the first dimming value compensator 110 has three spatial filters 112, 114 and 116 having different filter coefficients.

The first spatial filter 112 is intended for a high gray area at the first position, that is, a high gray area farthest from an upper adjacent block, as illustrated in FIG. 3(A). The first spatial filter 112 primarily compensates the dimming values of the block and its left and right adjacent blocks by filtering with a 3×1 size and the same filter coefficient for the blocks. The selector 118 selects the output of the first spatial filter 112 in response to first position information received from the high gray area detector 106 and outputs the selected output to the second dimming value compensator 124.

The second spatial filter 114 is intended for a high gray area at the second position, that is, a high gray area in the middle from an upper adjacent block, as illustrated in FIG. 3(B). The second spatial filter 112 primarily compensates the dimming values of the block, its left and right adjacent blocks, and adjacent blocks over these three blocks by filtering with a 3×3 size and predetermined filter coefficients set for the six blocks. The selector 118 selects the output of the second spatial filter 114 in response to second position information received from the high gray area detector 106 and outputs the selected output to the second dimming value compensator 124.

The third spatial filter 116 is intended for a high gray area at the third position, that is, a high gray area nearest to an upper adjacent block, as illustrated in FIG. 3(C). The third spatial filter 116 primarily compensates the dimming values of the block, its left and right adjacent blocks, and adjacent blocks over these three blocks by filtering with a 3×3 size and predetermined filter coefficients set for the six blocks. The selector 118 selects the output of the third spatial filter 116 in response to third position information received from the high gray area detector 106 and outputs the selected output to the second dimming value compensator 124.

Figure 3:
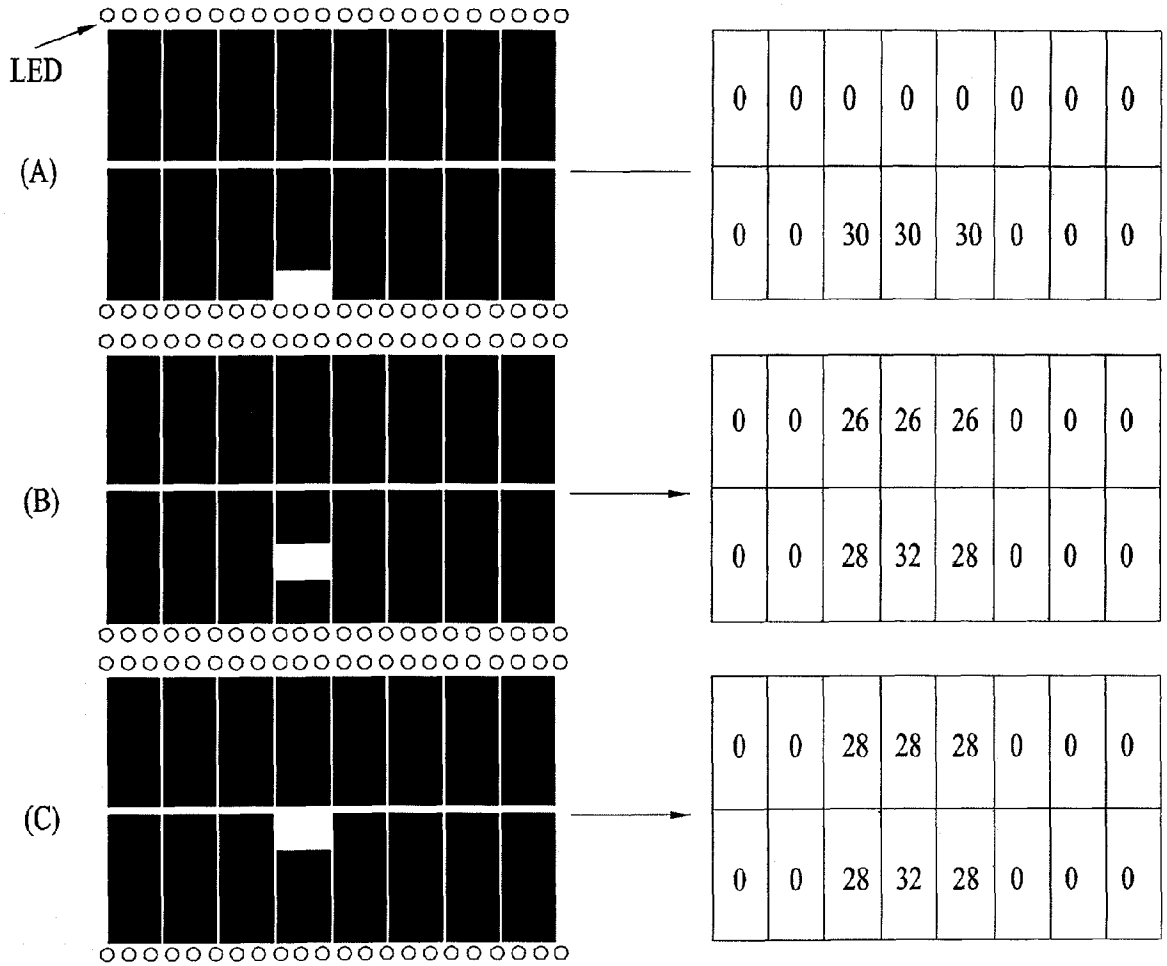
FIG. 3 illustrates spatial filters that are applied according to distances between a high-level gray area in a block and an adjacent block according to an exemplary embodiment of the present invention.

As noted from FIG. 3, as a high gray area of a block is farther from an upper adjacent block, the spatial filter size is smaller and under the same spatial filter size, the filter coefficients of upper blocks adjacent to the block with the high gray area decrease. In this manner, the first dimming value compensator 110 changes a spatial filter size and filter coefficients of a block and its adjacent blocks, if the distance between a high gray area in the block and an adjacent block is changed. As a consequence, luminance non-uniformity among the blocks may be mitigated adaptively according to the distance between the high gray area and the adjacent block.

The first data compensator 120 calculates first gain values on a pixel basis using the local dimming values of the blocks received from the dimming value decider 104 and an optical profile of a preset light source, primarily compensates the input image data by applying the first gain values to the input image data, and outputs the primarily compensated data to the second data compensator 122. More specifically, the first data compensator 120 calculates a first total light intensity that reaches to each pixel using the optical profile in the case where the backlights are all at a maximum luminance and calculates a second total light intensity that reaches the pixel using the optical profile and the local dimming values of the blocks in the case where the backlight luminance is controlled on a block basis by local dimming, and calculates the ratio of the second total light intensity to the first total light intensity as a first gain value for the pixel. Then the first data compensator 120 primarily compensates for a local dimming-incurred luminance decrease in the input image data by multiplying the first gain values by the input image data.

The second data compensator 122 detects the maximum of the values of the data of each primarily compensated frame received from the first data compensator 120, calculates second gain values on a frame basis to convert the detected maximum value to a maximum gray level (e.g. 255), and secondarily compensates the primarily compensated data by applying the second gain values to the primarily compensated data. The second data compensator 122 outputs the secondarily compensated data to the timing controller 20 and the second gain values of the respective frames to the second dimming value compensator 124.

The second dimming value compensator 124 secondarily compensates the primarily compensated dimming values of the respective blocks by applying the second gain values to the primarily compensated dimming values, and outputs the secondarily compensated dimming values to the backlight driver 30.

As described above, the LCD device according to the present invention may mitigate luminance non-uniformity among blocks according to the position of a high gray area in a block by changing a spatial filter size and filter coefficients, if the distance of the high gray area of the block and an adjacent block is changed.

While the exemplary embodiments of the present invention have been described above in the context of an edge-type backlight unit, it is to be understood that the present invention is also applicable to a direct-type backlight unit.

As is apparent from the above description, the driving method and apparatus for local dimming of an LCD device according to the present invention compensate the dimming value of each block by changing a spatial filter size and filter coefficients for blocks according to the distance between a high gray area of the block and an adjacent block. Therefore, luminance non-uniformity among blocks can be mitigated according to the distance between the high gray area and the adjacent block.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A driving method for local dimming of a Liquid Crystal Display (LCD) device, comprising:

determining a dimming value of each of a plurality of local dimming blocks into which a backlight unit is divided to be driven on a block basis by analyzing input image data on a block basis;

detecting a high gray area concentrated with high gray levels from each local dimming block based on the analysis of the input image data, and generating position information about the high gray area according to a distance between the high gray area in the block and an adjacent block;

compensating the dimming value of each of the plurality of local dimming blocks by spatial filtering using a spatial filter having a different filter size or different filter coefficients for local dimming blocks according to the position information about the high gray area in the local dimming block; and calculating a first gain value on a pixel basis using the dimming values of the local dimming blocks and an optical profile of a preset light source and compensating the input image data by applying the first gain values of pixels to the input image data, wherein the first gain value is calculated as a ratio of a second total light intensity to a first total light intensity, wherein the first total light intensity is to calculate a total light intensity that reaches to each pixel using the optical profile in the case where the backlights are all at a maximum luminance and the second total light intensity is to calculate a total light intensity that reaches the pixel using the optical profile and the local dimming values of the blocks in the case where the backlight luminance is controlled on a block basis by local dimming.

2. The driving method according to claim 1, further comprising:

calculating a second gain value on a frame basis for use in converting a maximum value of compensated image data of one frame to a maximum gray level representable in the input image data, and secondarily compensating the compensated image data by applying the second gain values of frames to the compensated image data; and secondarily compensating the compensated local dimming values of the local dimming blocks by applying the second gain values to the compensated local dimming values.

3. The driving method according to claim 2, wherein as the distance between the high gray area in the block and the adjacent block is larger, the spatial filter size used is smaller.

4. The driving method according to claim 2, wherein as the distance between the high gray area in the block and the adjacent block is larger, the filter coefficients for the blocks used are smaller.

5. The driving method according to claim 2, further comprising:

providing the secondarily compensated image data to a liquid crystal panel; and controlling luminance of the backlight unit on a block basis by driving the backlight unit on a block basis using the secondarily compensated dimming values of the local dimming blocks.

6. A driving apparatus for local dimming of a Liquid Crystal Display (LCD) device, comprising:

an image analyzer that detects a maximum value for each pixel by analyzing input image data over each of a plurality of local dimming blocks into which a backlight unit is divided to be driven on a block basis, and detects a representative gray level for each block using the maximum values of pixels in the block;

a dimming value decider that determines a dimming value on a block basis according to the representative gray level of each block;

a high gray area detector that detects a high gray area concentrated with high gray levels from each block based on the maximum value of each pixel received from the image analyzer, and generates position information about the high gray area according to a distance between the high gray area in the block and an adjacent block;

a dimming value compensator that compensates the dimming value of each of the plurality of local dimming blocks by spatial filtering using a spatial filter having a different filter size or different filter coefficients for blocks according to the position information about the high gray area in the block; and a data compensator that calculates a first gain value on a pixel basis using the dimming values of the local dimming blocks received from the dimming value decider and an optical profile of a preset light source and compensates the input image data by applying the first gain values of pixels to the input image data, wherein the data compensator calculates a first total light intensity that reaches to each pixel using the optical profile in the case where the backlights are all at a maximum luminance and calculates a second total light intensity that reaches the pixel using the optical profile and the local dimming values of the blocks in the case where the backlight luminance is controlled on a block basis by local dimming, and calculates the ratio of the second total light intensity to the first total light intensity as a first gain value for the pixel.

7. The driving apparatus according to claim 6, further comprising:

a second data compensator that calculates a second gain value on a frame basis for use in converting a maximum value of compensated image data of one frame received from the data compensator to a maximum gray level representable in the input image data, and secondarily compensates the compensated image data by applying the second gain values of frames to the compensated image data; and a second dimming value compensator that secondarily compensates the compensated local dimming values of the local dimming blocks by applying the second gain values received from the second data compensator to the compensated local dimming values.

8. The driving apparatus according to claim 7, wherein as the distance between the high gray area in the block and the adjacent block is larger, the spatial filter size is smaller.

9. The driving apparatus according to claim 7, wherein as the distance between the high gray area in the block and the adjacent block is larger, the filter coefficients for the blocks are smaller.

10. The driving apparatus according to claim 7, further comprising:

a panel driver that provides the secondarily compensated image data to a liquid crystal panel; and a backlight driver that controls luminance of the backlight unit on a block basis by driving the backlight unit on a block basis using the secondarily compensated dimming values of the local dimming blocks.

* * * * *